US006773319B1

(12) United States Patent
Carlini, Jr.

(10) Patent No.: US 6,773,319 B1
(45) Date of Patent: Aug. 10, 2004

(54) WATER JET POWERED FLOATING DEVICE FOR POOLS

(76) Inventor: Archie M. Carlini, Jr., 2106 Autumn Leaf La., Winter Haven, FL (US) 33884

( * ) Notice: Subject to any disclaimer, the term of this patent is extended or adjusted under 35 U.S.C. 154(b) by 0 days.

(21) Appl. No.: 10/638,632

(22) Filed: Aug. 11, 2003

(51) Int. Cl.[7] ..... B63C 9/08
(52) U.S. Cl. ..... 441/130; 440/40
(58) Field of Search ..... 441/130, 132; 440/38, 40

(56) References Cited

U.S. PATENT DOCUMENTS 4,115,888 A * 9/1978 Sievers ..... 440/38
5,403,220 A * 4/1995 Goad, Sr. ..... 441/130
5,857,226 A 1/1999 Sommer
5,884,965 A 3/1999 Allen
5,970,532 A 10/1999 Modica
5,979,976 A 11/1999 Ferencik
6,045,423 A 4/2000 Silvia
6,149,234 A 11/2000 Daniels
6,171,160 B1 1/2001 Skaggs et al.
6,375,522 B1 * 4/2002 Bellens et al. ..... 440/40
6,520,814 B1 * 2/2003 Elias et al. ..... 440/38
6,626,491 B1 9/2003 Blome et al.

* cited by examiner

*Primary Examiner*—S. Joseph Morano
*Assistant Examiner*—Lars A. Olson
(74) *Attorney, Agent, or Firm*—Dennis G. LaPointe; Mason Law, P.L.

(57) ABSTRACT

The present invention is a water jet powered floatable device for an above-ground pool or an in-ground pool comprising, in combination, a floatable device and a water flow conduit system with a control valve to direct the exiting of the water either downwardly in the pool to maintain a relatively stationary position or laterally behind the floatable device in a direction to create a forward thrust or a turning movement of the floatable pool chair in a right or left turning direction. Optionally, a reverse mode may be incorporated by having an outlet directed forward of the floatable device.

6 Claims, 3 Drawing Sheets

WATER JET POWERED FLOATING DEVICE FOR POOLS

The invention relates to floating devices such as pool chairs, inflatable toys, inflatable toys capable of being ridden on or on which one can float, using a water jet propulsion and control system for maneuvering the device on the water, typically above-ground and in-ground swimming pools.

Devices designed to float on the water, such as those mentioned above, must typically be moved by hand paddling to different parts of the pool. When a pool lounger is on the floatable device trying to hold and balance a drink or snacks, it is difficult to paddle the chair with one hand, yet prevent any spilling of a drink and dropping of snacks in the pool, or even prevent the snacks from getting wet or pool water from splashing into the drink. What is needed for the serious pool water lounger is a propulsion and control system for the floatable device that frees the pool chair occupant's hands to enjoy his drink and snacks. In addition, persons that have physical handicaps would also benefit because with a propulsion and control system as contemplated herein, they would now have the ability for independent mobility in a pool or water environment. Further, floatable toys such as inflatable jet skis for children, can incorporate the inventive system to enhance the pleasure of riding or floating on water.

The present invention is such a system using a system of water flow conduits and a control valve together with a push rod to direct the outflow of the water, which in turn propels the floating device in a desired direction. The system also has a provision using a control valve, such as a 3-way valve or other valve/manifold combination to create a selective multi-path or multi-port feature, to redirect the outflow water straight down toward the bottom of the pool when the occupant of the floatable device desires to remain in one location on the pool surface, that is, a stationary position.

The present invention can be combined with any floatable device such as a pool chair, including those with reclining backs and leg supports such as lounge chairs, inflatable chairs, floats, recreational floatable devices such as inflatable jet skis, motorcycles or animals for kids, etc. Typically, chairs are made totally with a foam product or the arms are made from a foam product to provide for the stationary floating of the chair or chaise lounge. In this particular application, for sake of simplicity, any reference to a floatable pool chair is to be considered synonymous to a standard floating pool chair or a floating pool chaise lounge, regardless of whether the back is reclinable or, if provided, the leg support portion of the chaise lounge is adjustable. Other devices may be strictly inflatable materials such as floats currently sold commercially. These floats can be configured when inflated to look like animals or riding devices such as jet skis. SUMMARY OF THE INVENTION The present invention is a water jet powered floatable device on which a person can ride and/or float for an above-ground pool or an in-ground pool comprising, in combination, the floatable device and a water flow conduit system. The water flow conduit system includes inlet conduit means configured on one end to connect to a source of water being pumped into said inlet conduit means. An opposite end of the inlet conduit means is in fluid communication with an inlet port of a control valve. The control valve acts as means for directing the flow of water so as to selectively provide for generally stationary positioning of the floatable device and/or propulsion of the floatable device when movement of the floatable device is desired. As used herein, the term "control valve" is defined as either a single handle compact valve with an inlet and multi-port outlets or as a manifold with an inlet and two or more valves to direct the water through the desired outlet port. In addition, the valve(s) may be simple mechanical ball valves or solenoid operated toggle-switched valve(s).

The invention includes stationary positioning water outlet conduit means, which is in fluid communication with a first outlet port of the control valve. The stationary positioning water outlet conduit means has a discharge outlet directed in a generally downward direction into the pool.

The propulsion water outlet conduit means is in fluid communication with a second outlet port of the control valve, and has a discharge outlet directed generally horizontally in a direction away from the back of the floatable device.

The invention further includes means for laterally directing the water being discharged through the discharge outlet of the propulsion water outlet conduit means so as to propel the floatable device in a desired direction. For example, the discharge may incorporate an outlet eyeball nozzle which may be adjustable to compensate or enhance turning radius (left or right) to give better directional control.

The source of water being pumped into said inlet conduit means is a pool water recirculation system return port and the inlet conduit means includes a flexible hose in fluid communication with the inlet port of the control valve. The flexible hose is of sufficient length to allow the floatable device to maneuver in desired directions on the pool surface. Although not necessary, if some pools have additional discharge outlets that when operating impact the performance of the propelled floatable device, then it may be advisable to simply plug the ports on one or more of the unused returns on the pool.

The control valve is preferably located juxtaposed one side of the floatable device such that it is accessible for manual manipulation by the occupant of the floatable device. For example, it may be located near one of the arms or sides of the floatable device within an arm's length reach.

The discharge outlet of the propulsion water outlet conduit means includes an orifice for increasing the velocity of the water being discharged into the pool. As mentioned above, the device may be a simple as an eyeball port like those used in returns at the pool wall. It can also be adjustable to increase of decrease the size of the orifice or to provide for slight angular adjustment as with eyeballs currently used in pool return ports.

The means for laterally directing the water being discharged through the discharge outlet of the propulsion water outlet conduit means so as to propel the floatable device in a desired direction, further comprises a control arm juxtaposed one of a side and an arm of the floatable pool chair. This control arm may be located near one of the sides or arms of the floatable device and preferably within an arm's length reach so it can be fully manipulated with minimal reaching effort, that is, it should be located such that it is accessible for manual manipulation by the occupant of the floatable device.

The control arm is also pivotally connected to one end of a push rod member. The push rod member is further engaged at its opposite end to a linking member connected to the propulsion water outlet conduit means near the discharge outlet of said propulsion water outlet conduit means. The propulsion water outlet conduit means has partial rotating means for laterally directing the discharge outlet so as to direct the floatable device in a left turn mode, a right turn mode or in a generally forward mode.

If a reverse mode was desired, an optional design may be to have a manifolded control valve with a separate outlet (third outlet port), or simply a 4-way valve, with a discharge (reverse mode conduit means) descending below the water surface with its discharge outlet directed toward the front of the floatable device.

DETAILED DESCRIPTION OF THE INVENTION

Figure 1:
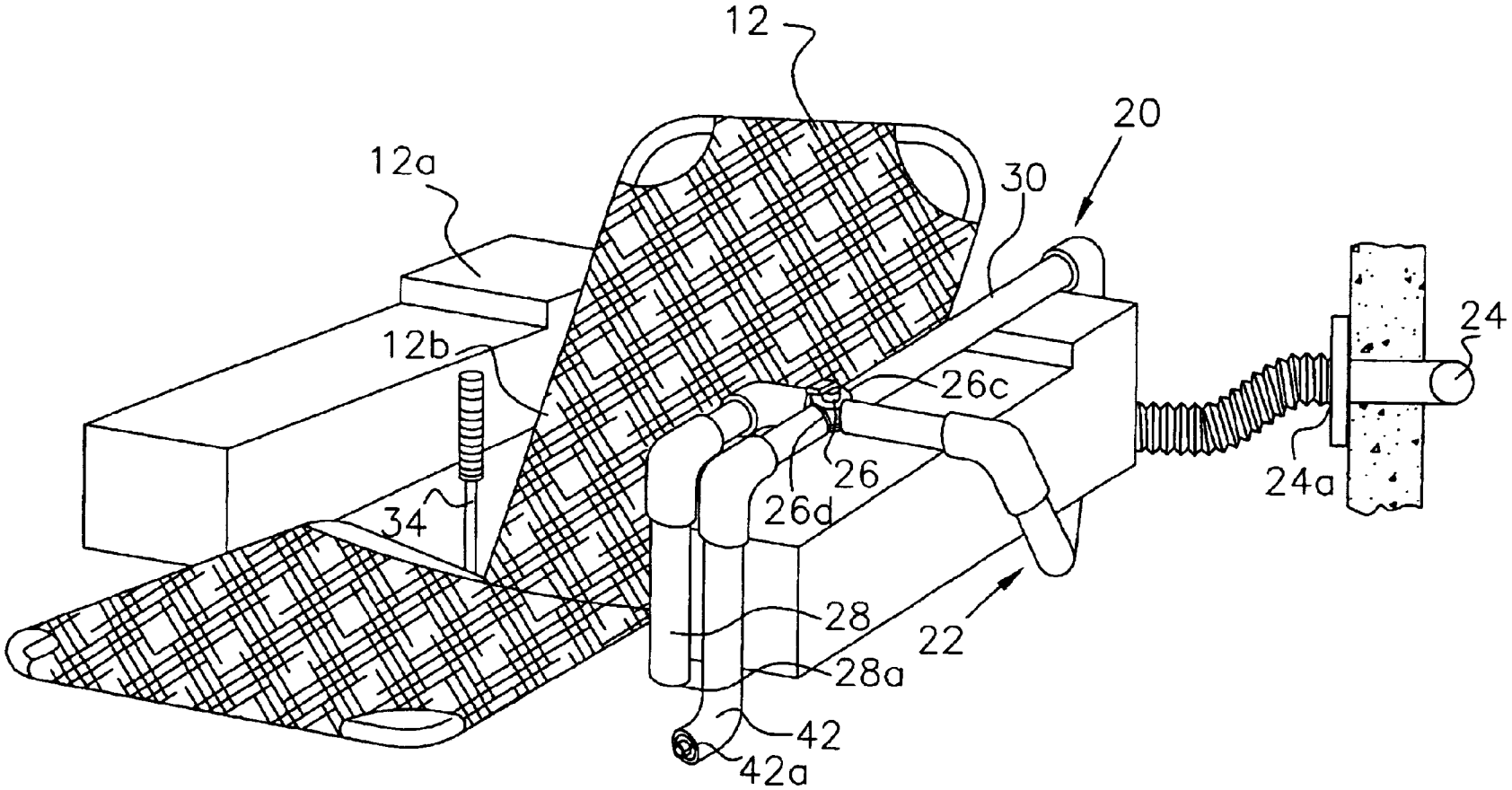
FIG. 1 is a schematic conceptual depiction of a floatable device in the form of a pool chair for demonstrative purposes only, modified to complete the present invention, in this case, using a 4-way valve/manifold system.
Figure 2:
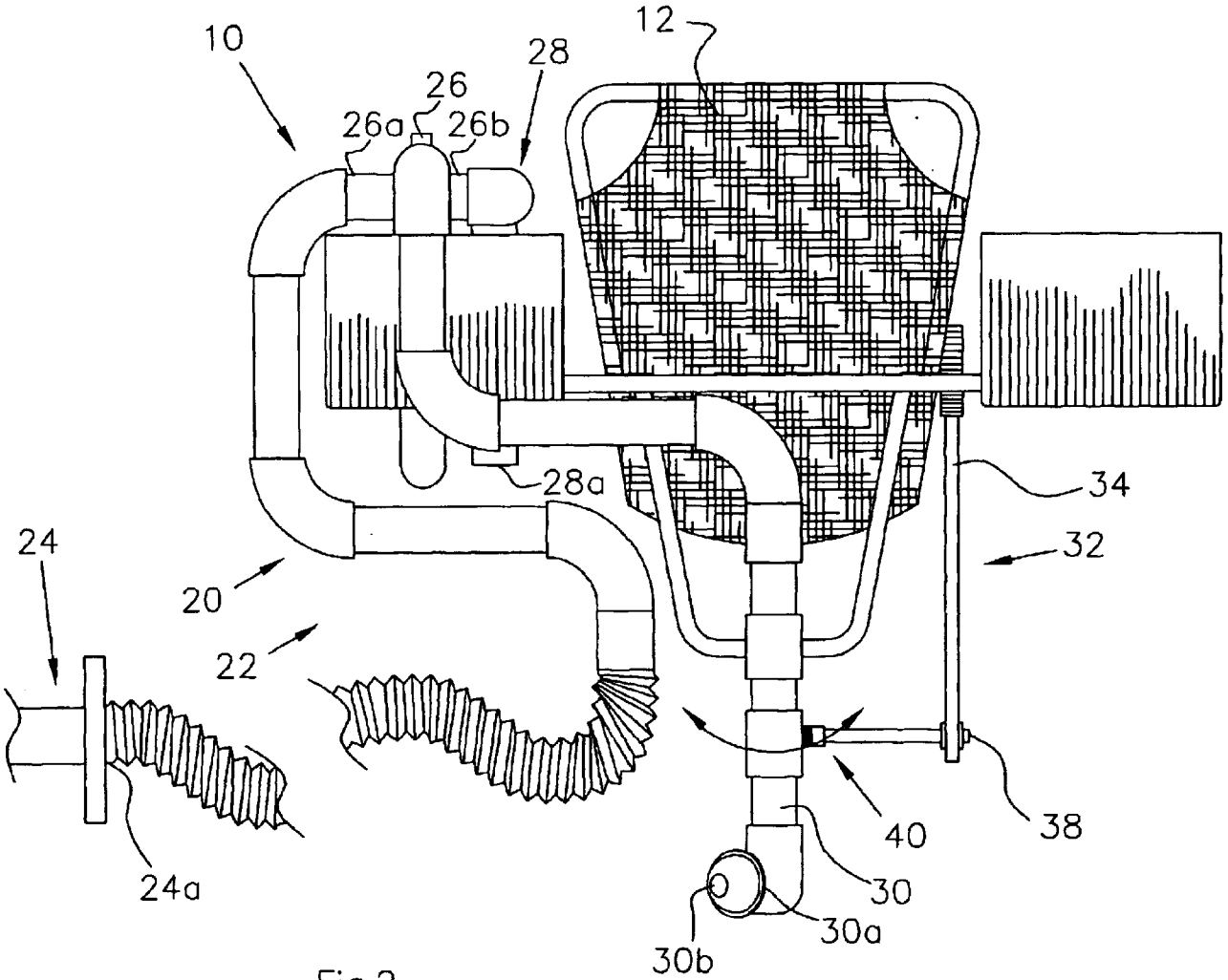
FIG. 2 is a schematic conceptual depiction of the depiction of FIG. 1 looking from the back side.

Referring now to the drawings, FIGS. 1, 2, 3*a* and 3*b* disclose an example of the present invention, which is a water jet powered floatable device, depicted generally as 10, for an above-ground pool or an in-ground pool. The drawing uses a chair as a floatable device to demonstrate the invention. It is understood that other floatable devices such as those already mentioned above may instead be combined with the propulsion and control system combined with the floatable device to comprise the invention.

The invention 10 accordingly comprises, in combination, a floatable device 12 and a water flow conduit system 20. The water flow conduit system 20 includes inlet conduit means 22 configured on one end to connect to a source 24 of water being pumped into said inlet conduit means 22. An opposite end of the inlet conduit means 22 is in fluid communication with an inlet port 26*a* of a control valve 26. The control valve 26 acts as means for directing the flow of water so as to selectively provide for generally stationary positioning of the floatable device 12 and/or propulsion of the floatable device 12 when movement of the floatable device 12 is desired.

The invention includes stationary positioning water outlet conduit means 28, which is in fluid communication with a first outlet port 26*b* of the control valve 26. The stationary positioning water outlet conduit means 28 has a discharge outlet 28*a* directed in a generally downward direction into the pool.

The propulsion water outlet conduit means 30 is in fluid communication with a second outlet port 26*c* of the control valve 26, and has a discharge outlet 30*a* directed generally horizontally in a direction away from the back of the floatable device 12.

The invention further includes means 32 for laterally directing the water being discharged through the discharge outlet 30*a* of the propulsion water outlet conduit means 30 so as to propel the floatable device 12 in a desired direction.

The source 24 of water being pumped into said inlet conduit means 22 is a pool water recirculation system return port 24*a* and the inlet conduit means 22 includes a flexible hose in fluid communication with the inlet port 26*a* of the control valve 26. In FIG. 1, source 24 of water is is depicted by the partial view of the pool recirculation or return piping running through the concrete wall of the pool and is therefore further representative of the pool recirculation system in total. Although FIG. 1 depicts the source 24 on the surface of a concrete wall, it may be the return line to an above ground pool as well. The source 24 contemplated to be used the present invention therefore is not limited to gunnite pools, but rather encompasses any type of pool where a pressured water source is available. FIG. 1 is therefore merely an example of one way to obtain a source 24 of pressured water flow when, in this example, using the invention in a gunnite pool. The flexible hose should of sufficient length to allow the floatable device 12 to maneuver in desired directions around the pool surface.

The control valve 26 is preferably located juxtaposed one side of the floatable pool chair 12 such that it is accessible for manual manipulation by the occupant of the floatable pool chair. For example, it may be located near one of the arms 12*a* or sides 12*b* of the floatable device 12 within an arm length reach.

The discharge outlet 30*a* of the propulsion water outlet conduit means 30 includes an orifice 30*b* for increasing the velocity of the water being discharged into the pool. This orifice 30*b* can typically be an eyeball type of nozzle like those used on return ports of swimming pools and accordingly also be adjustable in any direction, if needed.

The means 32 for laterally directing the water being discharged through the discharge outlet 30*a* of the propulsion water outlet conduit means 30 so as to propel the floatable device 12 in a desired direction, further comprises a control arm 34 juxtaposed one arm 12*a* or side 12*b* of the floatable device 12. As stated, this control arm 34 may be located near one of the sides or arms of the floatable device 12 and preferably within an arm's length reach so it can be fully manipulated with minimal reaching effort, that is, it should be located such that it is accessible for manual manipulation by the occupant of the floatable device 12.

Figure 3A:
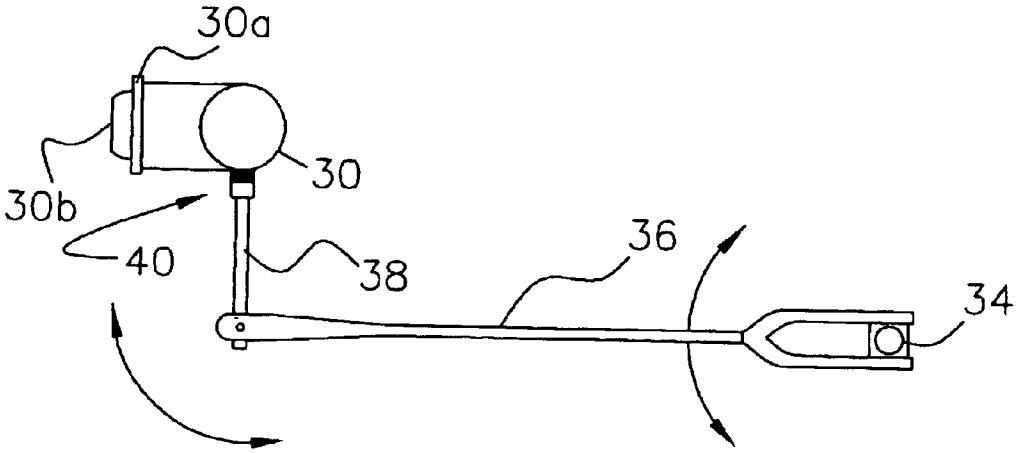
FIG. 3*a* is a conceptual representation of a portion of the control system.
Figure 3B:
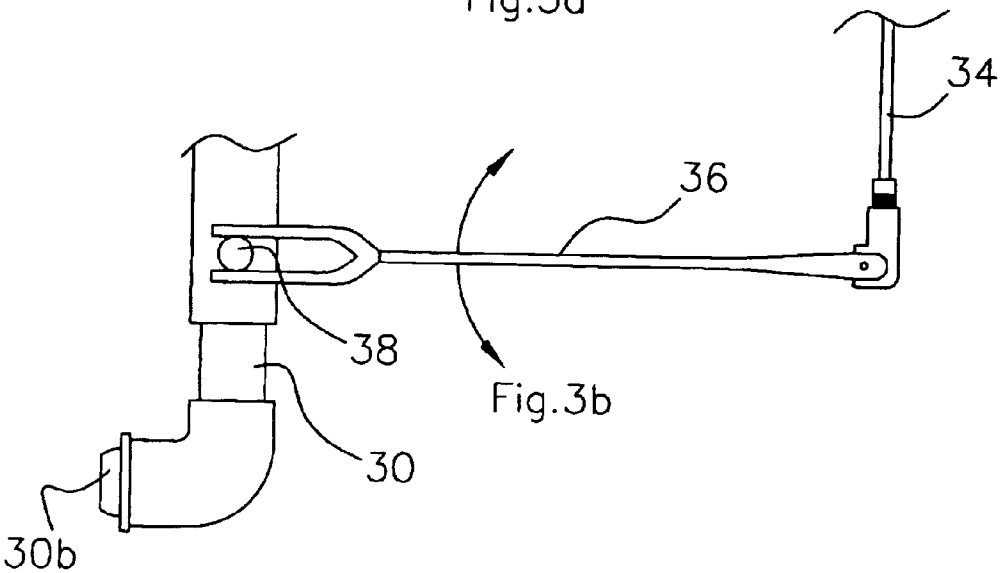
FIG. 3*b* is a side elevation view of the portion of the control system depicted in FIG. 3A.

The control arm 34 is also pivotally connected to one end of a push rod member 36. The push rod member 36 is further engaged at its opposite end to a linking member 38 connected to the propulsion water outlet conduit means 30 near the discharge outlet 30*a* of said propulsion water outlet conduit means 30. The propulsion water outlet conduit means 30 has partial rotating means 40 for laterally directing the discharge outlet 30*a* so as to direct the floatable device 12 in a left turn mode, a right turn mode or in a generally forward mode. As shown in FIG. 3*a* by the arrows on the right side near control arm 34, this joint area may be designed to allow some articulation of the control arm 34 in a left or right movement to allow even more accurate turning performance. That is, the joint at push rod 36 and control arm 34 could allow not only movement up and down caused by the forward and reverse thrusting of the control arm 34 but also some left and right movement caused by maneuvering the control arm left or right as well.

The conduit means in general can be made from a combination of polymer or metallic tubing or piping, as well as flexible tubing such as hoses, with fittings, quick-disconnect fittings, manifolds, valves, etc., to suit the run of the conduits needed for the particular floatable device modified by the present invention. Part of such conduit means can be built into the floatable (arms, seat, back portions) or all external. One skilled in the piping trade should be able to route the conduit means to suit as long as the water inlet fitting is readily accessible, the control valve is ready manipulated and the control arm is also readily accessible. The latter control arm can also be built into part of the pool chair such as the arm of the chair. The drawings included in this application are merely conceptual and all the conduit means depicted are external to the pool chair merely to help visualize the concept of the invention.

The control arm 34, push rod member 36 and linking means 38 may be made using tubing, channels or any other form of elongate structural member of sufficient length with mating ends having pivotable and/or rotatable joint, including universal type joints, if necessary.

The partial rotating means 40 for laterally directing the discharge outlet 30*a* so as to direct the floatable pool chair 12 in a left turn mode, a right turn mode or in a generally forward mode can be a simple threaded fitting that allows some rotating capability, or it can be sealed coupling or fitting with bearings that allow rotation without leakage of the water. Although it is anticipated that the outlet and control arm, push rod and linking members can be designed so as to even allow a reverse mode, such a performance characteristic is felt to be unnecessary. In this case, the added linkages required for the control system may render the cost economically impractical to include in a commercial unit. If a reverse mode was desired, an optional design maybe to have a manifolded control valve 26 with a separate outlet (third outlet port) 26*d*, or simply a 4-way valve, with a discharge (reverse mode conduit means 42) descending below the water surface with its discharge outlet 42*a* directed toward the front of the floatable device 12.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention.

Rather, the scope of the invention is to be determined only by the appended claims and their equivalents.

What is claimed is:

1. A water jet powered floatable device for an above-ground pool or an in-ground pool comprising, in combination:

a floatable device being means for carrying and supporting a person on the surface of the water;

a water flow conduit system including:

inlet conduit means configured on one end to connect to a source of water being pumped into said inlet conduit means;

an opposite end of the inlet conduit means being in fluid communication with an inlet port of a control valve, the control valve being means for directing the flow of water so as to selectively provide for generally stationary positioning of the floatable device and propulsion of the floatable device when movement of the floatable device is desired;

stationary positioning water outlet conduit means being in fluid communication with a first outlet port of the control valve, said stationary positioning water outlet conduit means having a discharge outlet directed in a generally downward direction into the pool;

propulsion water outlet conduit means being in fluid communication with a second outlet port of the control valve, said propulsion water outlet conduit means having a discharge outlet directed generally horizontally in a direction away from the back of the floatable device; and means for laterally directing the water being discharged through the discharge outlet of the propulsion water outlet conduit means so as to propel the floatable device in a desired direction.

2. The water jet powered floatable device according to claim 1, wherein the source of water being pumped into said inlet conduit means is a pool water recirculation system return port and the inlet conduit means includes a flexible hose in fluid communication with the inlet port of the control valve.

3. The water jet powered floatable device according to claim 1, wherein the control valve is located juxtaposed one side of the floatable device such that it is accessible for manual manipulation by the occupant of the floatable device.

4. The water jet powered floatable device according to claim 1, wherein the discharge outlet of the propulsion water outlet conduit means includes an orifice for increasing the velocity of the water being discharged into the pool, the orifice being fixed or adjustable.

5. The water jet powered floatable device according to claim 1, wherein the means for laterally directing the water being discharged through the discharge outlet of the propulsion water outlet conduit means so as to propel the floatable device in a desired direction, further comprises:

a control arm juxtaposed one side of the floatable device;

the control arm being located such that it is accessible for manual manipulation by the occupant of the floatable device, and pivotally connected to one end of a push rod member;

the push rod member being further engaged at its opposite end to a linking member connected to the propulsion water outlet conduit means near the discharge outlet of said propulsion water outlet conduit means; and the propulsion water outlet conduit means having partial rotating means for laterally directing the discharge outlet so as to direct the floatable device in a left turn mode, a right turn mode or in a generally forward mode.

6. The water jet powered floatable device according to claim 1, further comprising:

reverse mode conduit means being in fluid communication with a third outlet port of the control valve, said reverse mode conduit means having a discharge outlet aligned to direct the flow of water in a direction generally forward of the floatable device to cause the reverse motion of the floatable device when floating on the water surface.

* * * * *